US007749016B2

(12) United States Patent
Ikeya et al.

(10) Patent No.: US 7,749,016 B2
(45) Date of Patent: Jul. 6, 2010

(54) LEVER-FITTING TYPE CONNECTOR WITH ROTATABLY INSERTABLE LOCKING LEVER

(75) Inventors: Kenichi Ikeya, Shizuoka-ken (JP); Tsuneyuki Takahashi, Atsugi (JP); Takahiro Yoneda, Atsugi (JP); Ryo Sawada, Atsugi (JP); Yasuhiro Sasaki, Shizuoka-ken (JP); Ken Yoshimura, Atsugi (JP); Nozomi Ito, Tochigi-ken (JP)

(73) Assignees: Yazaki Corporation, Tokyo (JP); Calsonic Kansei Corporation, Tokyo (JP)

( * ) Notice: Subject to any disclaimer, the term of this patent is extended or adjusted under 35 U.S.C. 154(b) by 293 days.

(21) Appl. No.: 11/661,747

(22) PCT Filed: Sep. 2, 2005

(86) PCT No.: PCT/JP2005/016137

§ 371 (c)(1), (2), (4) Date: Jan. 31, 2008

(87) PCT Pub. No.: WO2006/030652

PCT Pub. Date: Mar. 23, 2006

(65) Prior Publication Data

US 2008/0260457 A1 Oct. 23, 2008

(30) Foreign Application Priority Data

Sep. 3, 2004 (JP) ..... 2004-257084

(51) Int. Cl.
*H01R 13/627* (2006.01)

(52) U.S. Cl. ..... 439/364; 439/680

(58) Field of Classification Search ..... 439/364, 439/680

See application file for complete search history.

(56) References Cited

U.S. PATENT DOCUMENTS 5,376,016 A 12/1994 Inaba et al.
6,592,392 B2 * 7/2003 Po-Heng ..... 439/358
7,147,504 B2 * 12/2006 Ikeya et al. ..... 439/364

(Continued)

FOREIGN PATENT DOCUMENTS

JP 62-121788 8/1987

(Continued)

OTHER PUBLICATIONS

Japanese Office Action dated Feb. 10, 2009.

*Primary Examiner*—Tho D Ta
(74) *Attorney, Agent, or Firm*—Finnegan, Henderson, Farabow, Garrett & Dunner, L.L.P.

(57) ABSTRACT

A lever insertion hole (6) for inserting a lever (5) is provided in a female housing (2). A rib (10) and a flexible lever-holding lock (11) are arranged on the inner wall (6A) of the lever insertion hole (6). The rib (10) enables the lever (5) to be inserted, through a key groove (54) axially provided in the outer peripheral surface of the lever (5), into the female housing (2) only when the lever (5) is at a predetermined rotational position. The rib (10) and the lever-holding lock (11) are together in contact with a wall section (57) of a coming-out prevention groove (56), provided in the lever (5), to hold the lever (5) from coming out.

5 Claims, 11 Drawing Sheets

U.S. PATENT DOCUMENTS

2004/0002249 A1 1/2004 Yamada et al.

FOREIGN PATENT DOCUMENTS

| | | |
|---|---|---|
| JP | 3-86576 | 9/1991 |
| JP | 6-13069 | 2/1994 |
| JP | 06-029066 | 2/1994 |
| JP | 06-104050 | 4/1994 |
| JP | 7-41103 | 7/1995 |
| JP | 11-054203 | 2/1999 |
| JP | 2004-031235 | 1/2004 |

* cited by examiner

LEVER-FITTING TYPE CONNECTOR WITH ROTATABLY INSERTABLE LOCKING LEVER

TECHNICAL FIELD

The present invention relates to a lever-fitting type connector capable of fitting or disconnecting a male connector and a female connector into or from each other by a lever rotating operation.

BACKGROUND ART

There is conventionally known a bolt-fitting type connector for fitting a male connector and a female connector into each other by rotating a bolt as shown in FIG. 1 (Japanese Patent Application Laid-open No. H11-54203). As shown in FIG. 1, this bolt-fitting type connector is configured such that a bolt 102 is held by a pair of flexible arms 103 from both sides of the bolt 102 while the bolt 102 is rotatably inserted into a bolt-insertion hole 101 formed in a female housing 100. As shown in FIGS. 1 and 2, protrusions 105 engaged with a concave groove 104 formed around a circumferential surface of the bolt 102 are provided on surfaces of the respective flexible arms 103 on which surfaces their free ends are opposed to each other. A tip end of the bolt 102 is mated with a nut fixed to a male housing (not shown) and the bolt 102 is rotated while the bolt 102 is thus held by the female housing 100, whereby the male and female housing are drawn toward each other and fitted into each other.

DISCLOSURE OF THE INVENTION

However, the above conventional bolt-fitting type connector employs the paired flexible arms 103 as means for stopping the bolt 102 at the female housing 100. Due to this, buckling tends to occur to the flexible arms 103 and force for holding the bolt 102 tends to be weakened when the bolt 102 is tightened.

To increase the bolt holding force of the flexible arms 103, it is necessary to intensify strength of the flexible arms 103 by making the flexible arms 103 themselves larger. However, in the connector for which space requirement is strict in an ongoing state of connector downsizing, the flexible arms 103 cannot be made large, with the result that the connector is disadvantageously incapable of satisfying high fitting performance.

Furthermore, the above bolt-fitting type connector is required to simultaneously release the paired flexible arms 103 during an operation for disconnecting the male and female housings from each other to release fitting state thereof so as to cause the paired flexible arms 103 to hold the bolt 102, resulting in poor release operability.

It is, therefore, an object of the present invention to provide a lever-fitting type connector that can be downsized and that can improve lever release operability.

According to an aspect of the present invention, there is provided a lever-fitting type connector comprising: a first connector housing; a second connector housing to be fitted into the first connector housing; and a lever rotatably held by the first connector housing, drawing the second connector housing by being rotated to fit the first connector housing and the second connector housing into each other, and including a guide groove axially formed on an outer circumferential surface of the lever, wherein the first connector housing includes an insertion hole into which the lever is to be inserted, and a rib making the lever insertable into the first connector housing via the guide groove of the lever only when the lever is located at a predetermined rotation position and a lever-holding lock having flexibility are provided on an inner wall of the insertion hole, and the rib as well as the lever-holding lock abuts on a retaining unit provided on the lever, thereby preventing the lever from coming off from the first housing and holding the lever.

According to the above aspect of the present invention, the lever can be inserted into the insertion hole only when the rib provided on the inner wall of the insertion hole formed in the first connector housing meshes with the guide groove formed in the lever. Due to this, it is possible to prevent the lever from being inserted into the insertion hole when the lever is located at a position other than the predetermined rotation position in one of the connector housings.

Moreover, according to the above aspect of the present invention, the lever holding lock having flexibility and the rib that are provided on the inner wall of the insertion hole simultaneously abut on the retaining unit formed on the lever, thereby making it possible to prevent the lever from coming off and holding the lever. If the lever is to be released, the rib is caused to mesh with the guide groove, thereby releasing only a state where the lever holding lock is engaged with the lever. It is thereby possible to release the lever and improve lever release operability.

Furthermore, according to the above aspect of the present invention, since the lever can be inserted into the insertion hole by storing the rib provided on the inner wall of the insertion hole in the guide groove of the lever, it is possible to set dimensions for close fitting so as not to generate backlash between the insertion hole and the lever. This can prevent the lever from becoming shaky in a state where the lever holding lock is inserted into the insertion hole, irrespectively of strength and magnitude of the lever holding lock having flexibility. Accordingly, if the second housing is connected to the first housing by rotating the lever while the lever is held at the first housing, then it is possible to suppress shaking the lever and, therefore, ensure connecting the second housing to the first housing.

Further, in the lever-fitting type connector, the retaining unit can include a wall member of a first retaining groove provided continuously with the guide groove in a circumferential direction of the lever, the rib abutting on the first retaining wall; and a wall member of a second retaining groove provided parallel to the first retaining groove in the circumferential direction of the lever, the lever-holding lock abutting on the second retaining groove.

With this configuration, the first retaining groove that is abutted on by the rib provided on the inner wall of the insertion hole and that restricts axial movement of the lever when the lever is held in the insertion hole of the first connector housing and the second retaining groove parallel to this first retaining groove are formed in the lever. It is thereby possible for the rib and the lever holding lock to simultaneously prevent the lever from coming off and hold the lever even if the rib and the lever holding lock are located at axially different positions in the insertion hole.

Further, in the lever-fitting type connector, the rib can be arranged to be deviated from an abutment portion in which the lever-holding lock abuts on the retaining unit in a longitudinal direction of the lever by as much as an overstroke of the lever-holding lock, the retaining unit can be a wall surface of the retaining groove provided continuously with the guide groove in the circumferential direction of the lever located, the wall surface located on a tip end side of the lever, and the retaining groove can include a wide portion abutted on by the rib and having a fixed width and a narrow portion abutted on by the lever-holding lock only while the lever can be fully stopped so that the retaining groove can prevent the lever from coming off and hold the lever simultaneously with the rib.

With this configuration, the rib is arranged to be deviated from the abutment portion in which the lever-holding lock abuts on the retaining unit by as much as the overstroke of the lever-holding lock. Due to this, the wall surface of the wide portion abutted on by the rib and that of the arrow portion abutted on by the lever holding lock when the lever is in the fully stopped state are formed on the lever, thereby making it possible to prevent backlash of the lever.

Moreover, in the lever-fitting type connector, the wide portion and the narrow portion can be continuous with each other via a tapered surface.

With this configuration, by making the wall surface of the wide portion and that of the narrow portion continuous with each other via the tapered surface, the lever holding lock can slide on the tapered surface and the wall surface of the narrow portion can smoothly move with respect to the lever holding lock when the lever is rotated. It is thereby possible to improve operability.

Furthermore, in the lever-fitting type connector, an operating unit can be provided integrally with a base of the lever.

With this configuration, by providing the operating unit integrally with the base of the lever, it is possible to facilitate rotating the lever.

BEST MODE FOR CARRYING OUT THE INVENTION

A lever-fitting type connector according to an embodiment of the present invention is explained below in detail.

The outline of the lever-fitting type connector according to the embodiment of the present invention is as follows. A lever having a rod-like part rotatably inserted into and held by a female housing that serves as one connector housing is rotated, thereby a male housing serving as the other connector housing is drawn and the both connector housings are fitted into each other. An insertion hole for inserting the lever is provided in the female housing. On an inner wall of this insertion hole, a rib that causes the lever to be insertable only when the lever is located at a predetermined rotation position, and a lever-holding lock having flexibility are provided. This rib is configured to abut on a retaining unit provided on the lever simultaneously with the lever-holding lock and to prevent the lever from coming off and to hold the lever.

Figure 1:
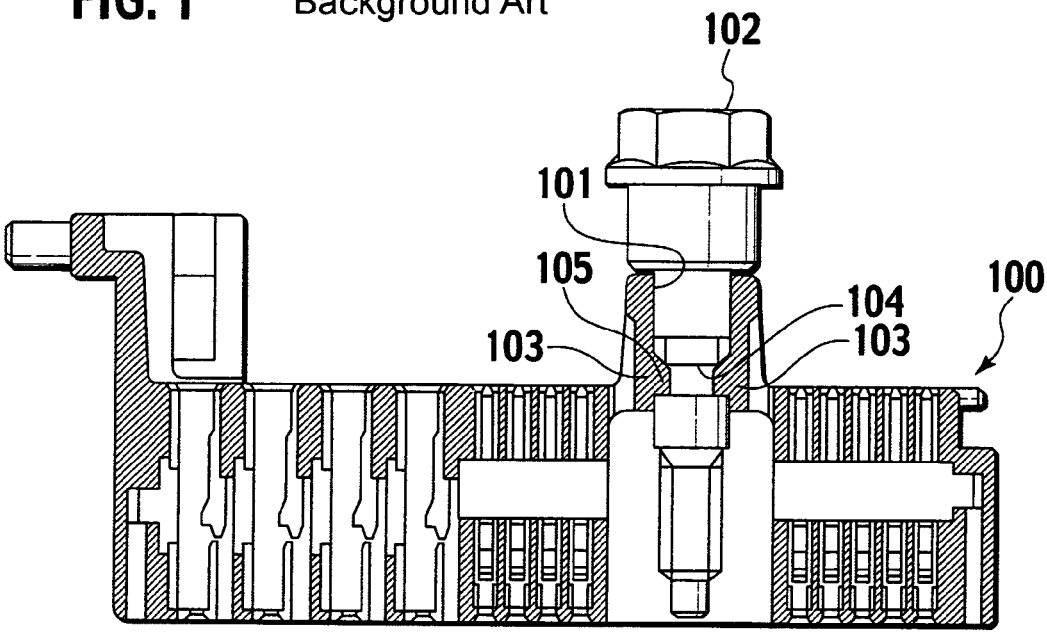
FIG. 1 Background Art
FIG. 1 is a cross-sectional view of a conventional connector.
Figure 2:
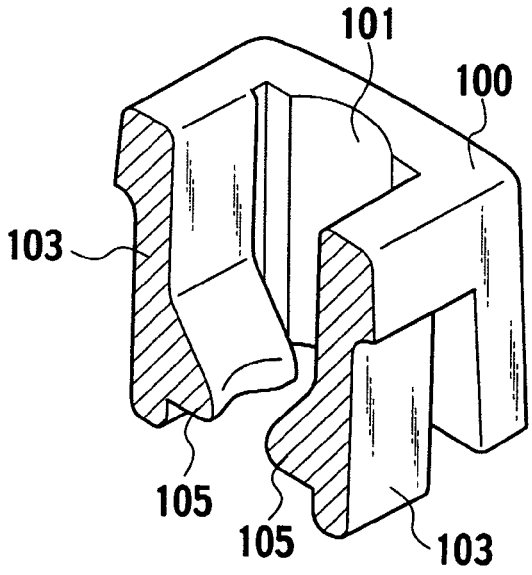
FIG. 2 Background Art
FIG. 2 is a perspective view of principal parts of the conventional connector.
Figure 3:
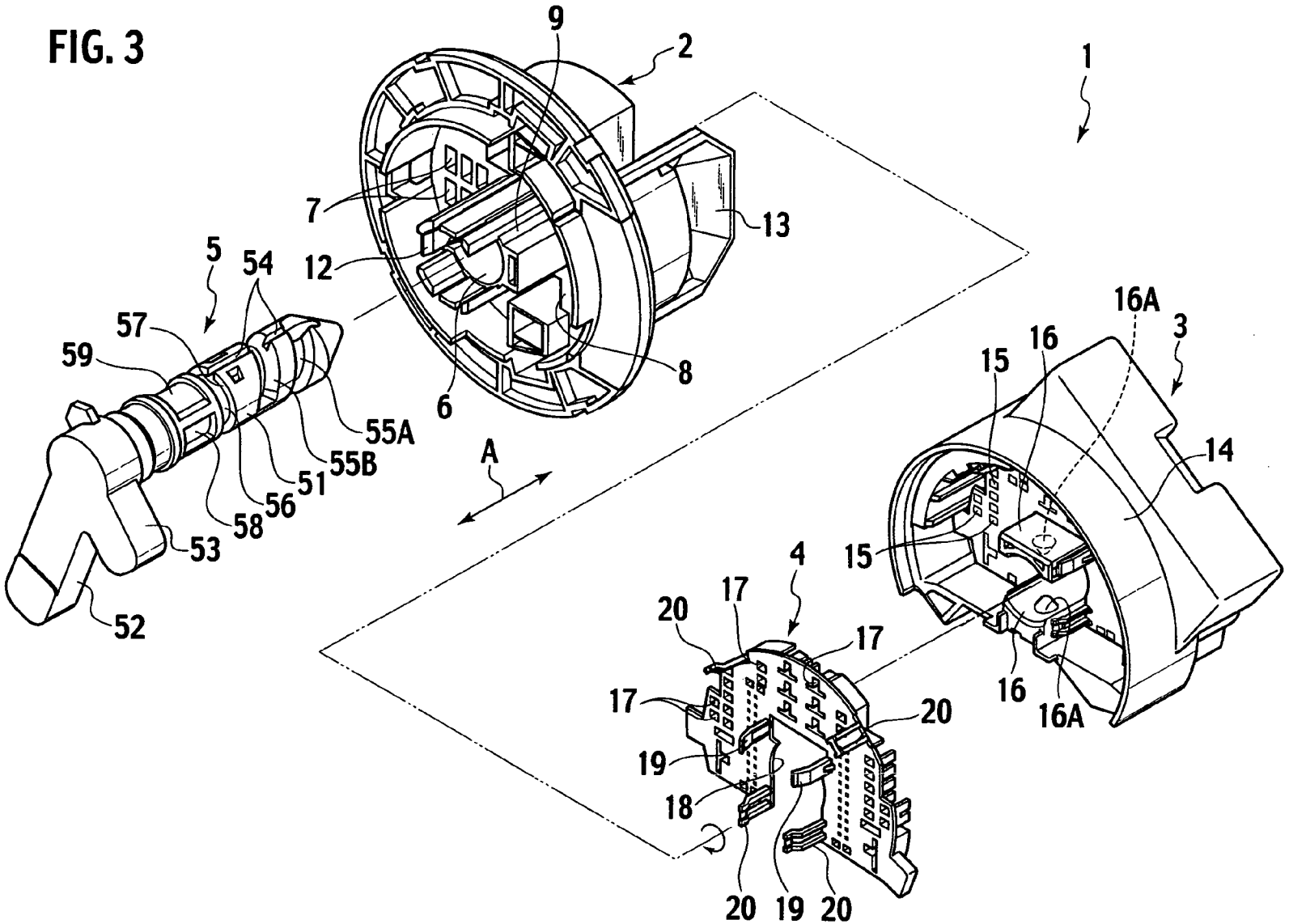
FIG. 3 is an exploded perspective view of a lever-fitting type connector according to an embodiment of the present invention.
Figure 4:
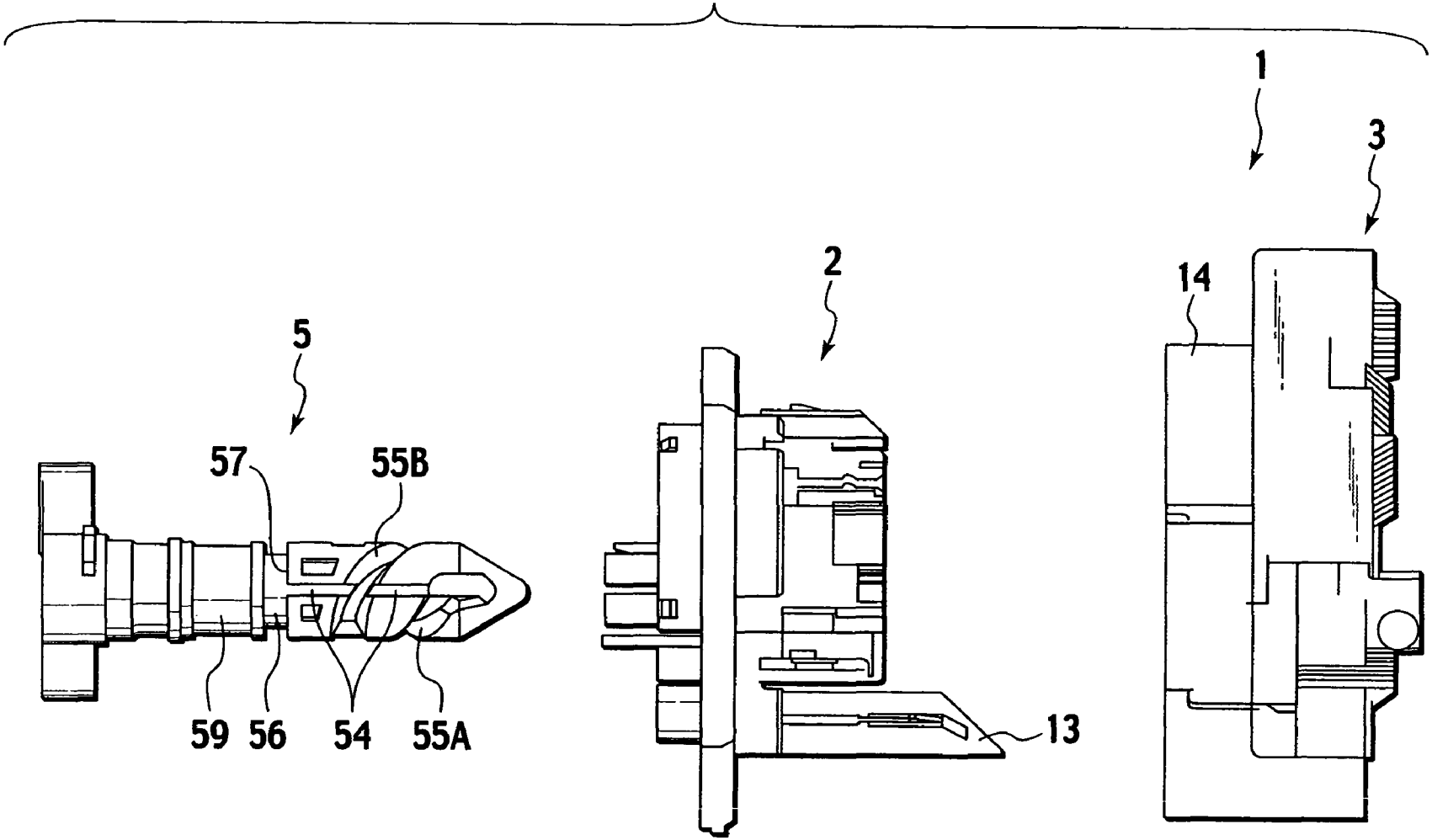
FIG. 4 is an exploded side view of the lever-fitting type connector according to the embodiment of the present invention.

The lever-fitting type connector according to the present embodiment will be described next based on the drawings. As shown in FIG. 3, a lever-fitting type connector 1 according to the embodiment roughly includes a female housing 2, a male housing 3, a moving plate 4, and a lever 5. FIG. 4 is a side view showing a state where the moving plat 4 is stored and set in the male housing 3.

[Configuration of Female Housing]

As shown in FIG. 3, a lever insertion hole 6 penetrating the female housing 2 in fitting directions A (indicated by an arrow) and serving as an insertion hole is formed generally at center in the female housing 2. Furthermore, a plurality of cavities 7 penetrating the female housing 2 along the fitting directions A is formed around the lever insertion hole 6 in the female housing 2. A female-terminal metal fitting (not shown) is stored and held in each of the cavities 7.

Moreover, a through wiring path 8 which a wire harness (not shown) can be inserted into and arranged in from one of the fitting directions A to the other fitting direction A of the female housing 2 without via a fitted portion in which the female housing 2 and the male housing 3 are fitted into each other is formed in the female housing 2 according to the present embodiment.

It is to be noted that a cover (not shown) for guiding and protecting a cable is provided on an end surface of the female housing 2 into the side of which surface the lever 5 is inserted.

The lever insertion hole 6 is a cylindrical hole of a cylinder 9 protruding from a generally central position on a non-fitted surface side of the female housing 2 toward a direction opposite to a direction in which the female housing 2 is fitted into the male housing 3, and is provided to penetrate a main body of the female housing 2.

Figure 5:
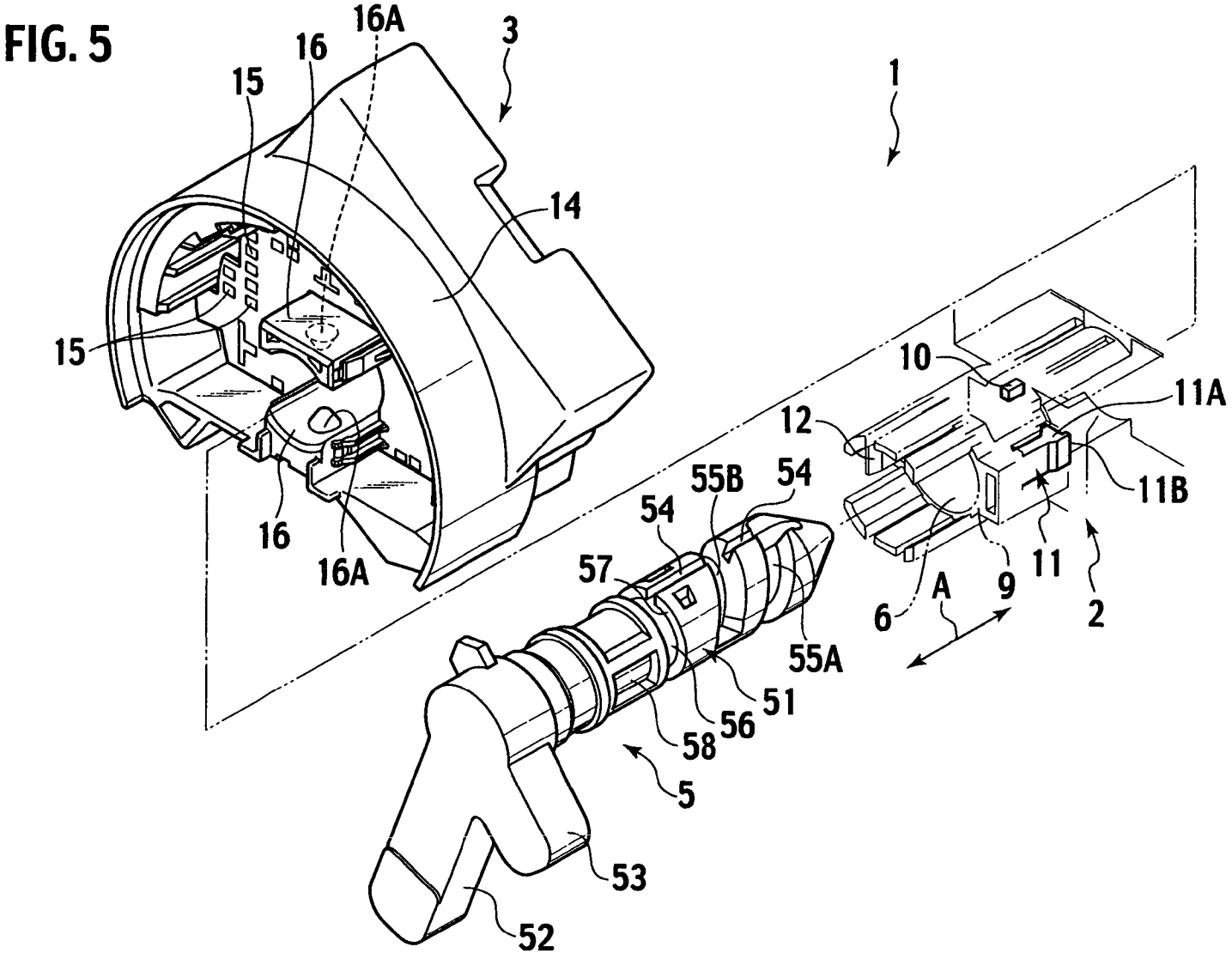
FIG. 5 is an exploded perspective view of the lever-fitting type connector according to the embodiment of the present invention.
Figure 8:
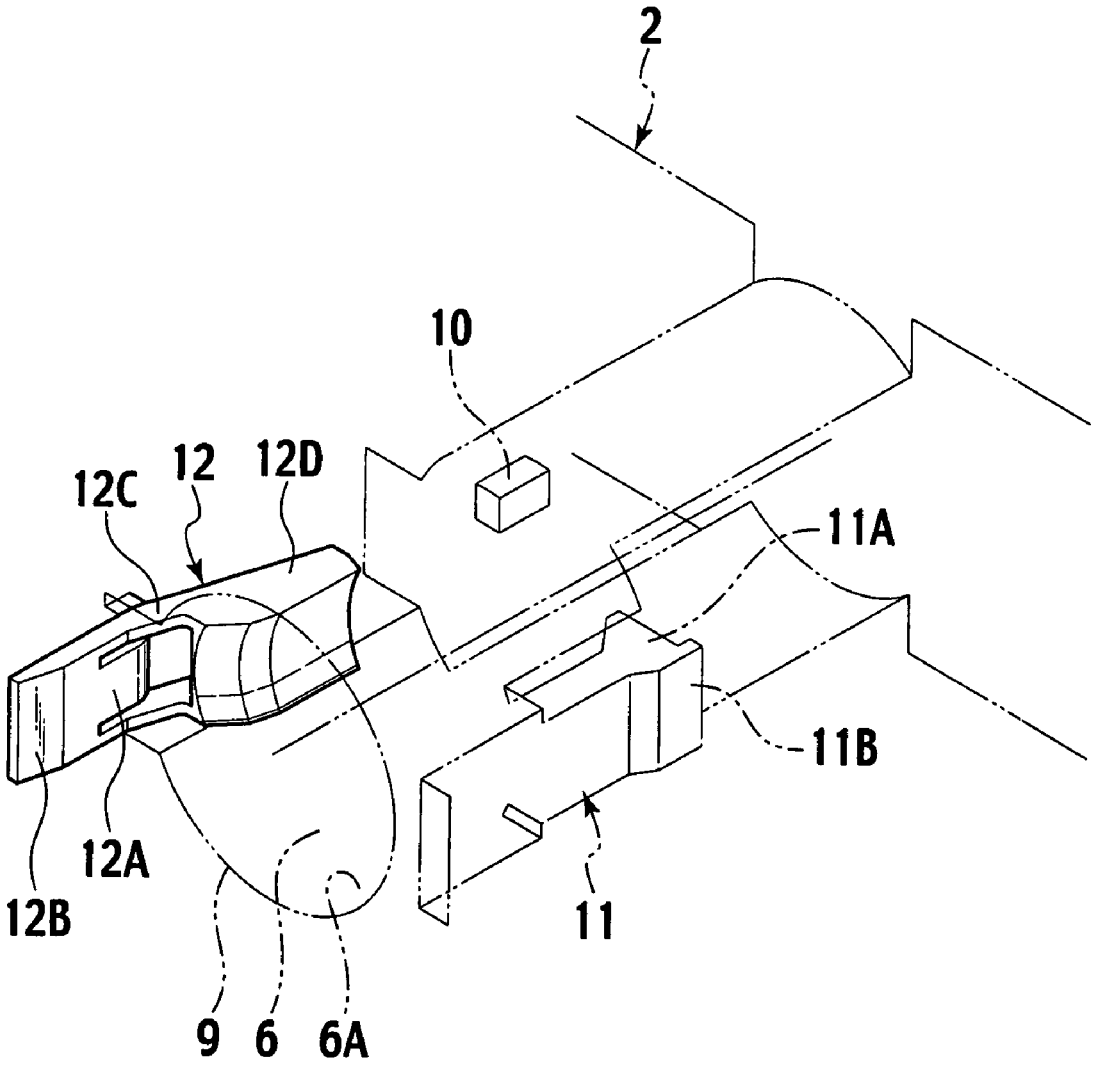
FIG. 8 is a perspective view of principal parts of a female housing according to the embodiment of the present invention.
Figure 9:
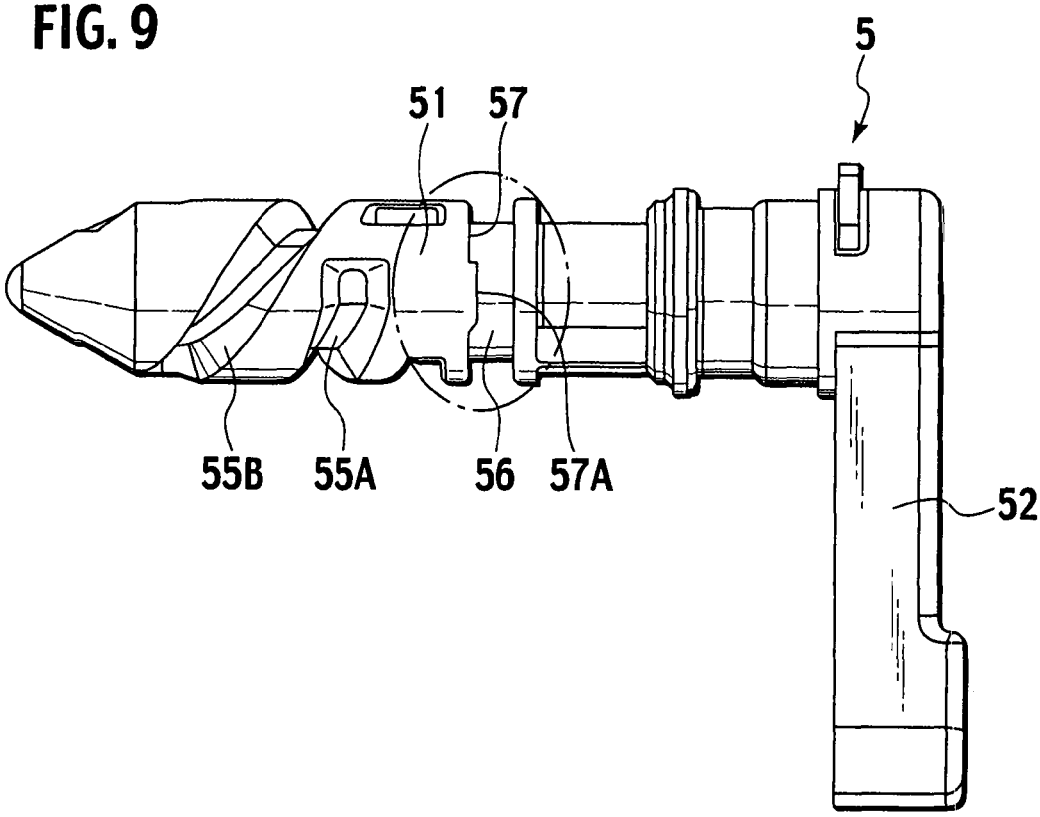
FIG. 9 is a side view of a lever according to the embodiment of the present invention.

As shown in FIGS. 5 and 8, a rib 10 protruding into the lever insertion hole 6, a flexible and arm-like lever holding lock 11 facing this lever insertion hole 6, and an anti-rotation lock 12 are provided on an inner wall of the lever insertion hole 6.

The rib 10, which is a rectangular parallelepiped small protrusion, is configured to be thrust into a key groove 54 that serves as a guide groove formed in the lever 5, to be described later, when the lever 5 is at a predetermined rotation angle with respect to the female housing 2.

Figure 6:
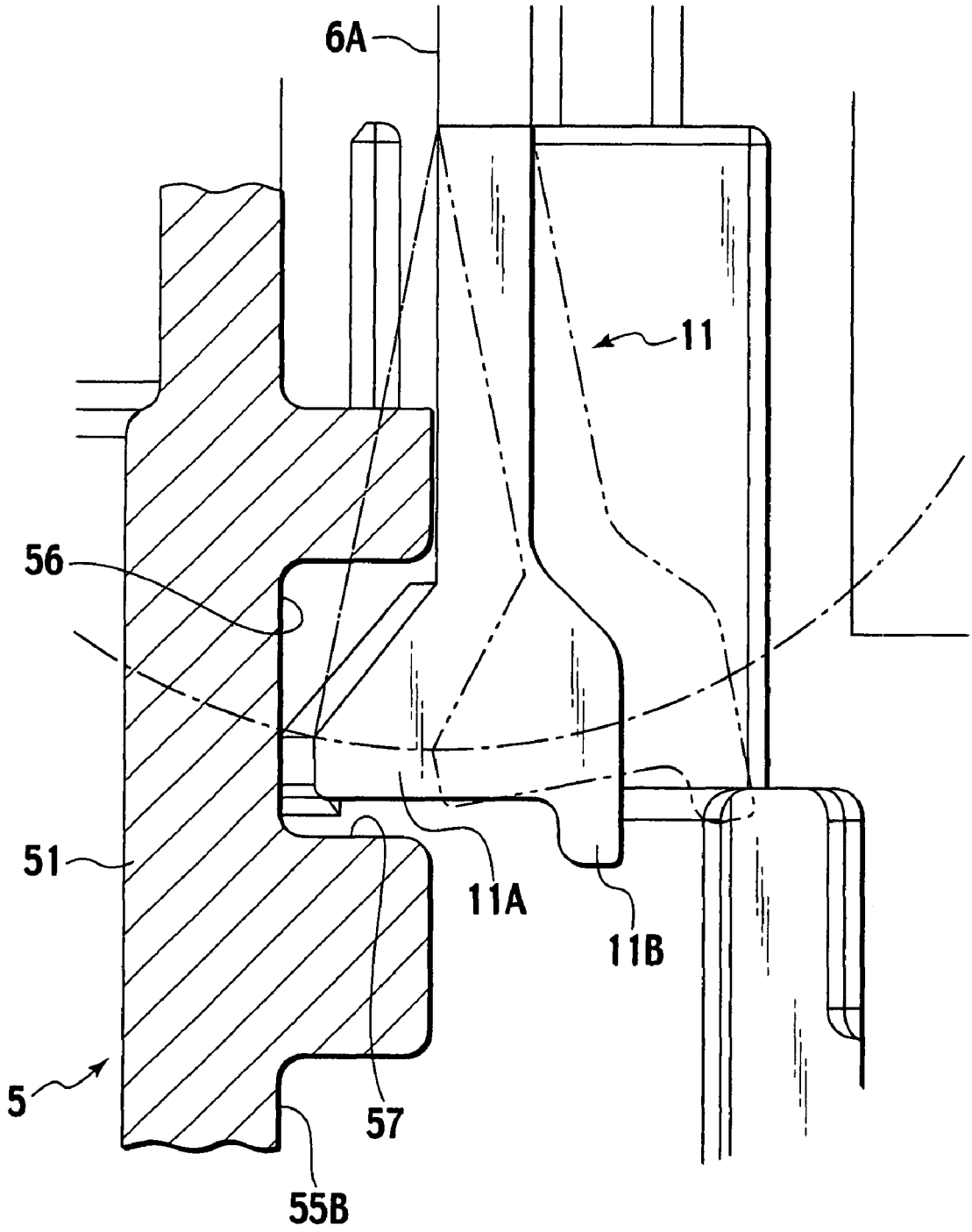
FIG. 6 is a cross-sectional view of principal parts of the lever-fitting type connector according to the embodiment of the present invention.

As shown in FIGS. 5, 6, and 8, the lever holding lock 11 forms a part of the inner wall of the lever insertion hole 6, and a lever holding protrusion 11A protruding into the lever insertion hole 6 is formed on a free end of the lever holding lock 11. Further, a lever release protrusion 11B into which a release tool (not shown) is caught protrudes toward the male housing 3 in the fitting directions A in an outside portion of the free end of the lever holding lock 11. As shown in FIGS. 5 and 6, a base of the lever holding lock 11 is integrally provided on an inner wall 6A of the lever insertion hole 6, on a lever inlet side in the fitting direction A.

In the present embodiment, as shown in FIGS. 5 and 8, the rib 10 and the lever holding protrusion 11A of the lever holding lock 11 are arranged at positions almost identical in depth in the lever insertion hole 6, the positions of which are deviated from each other by about 90 degrees around a rotation axis.

Figure 7:
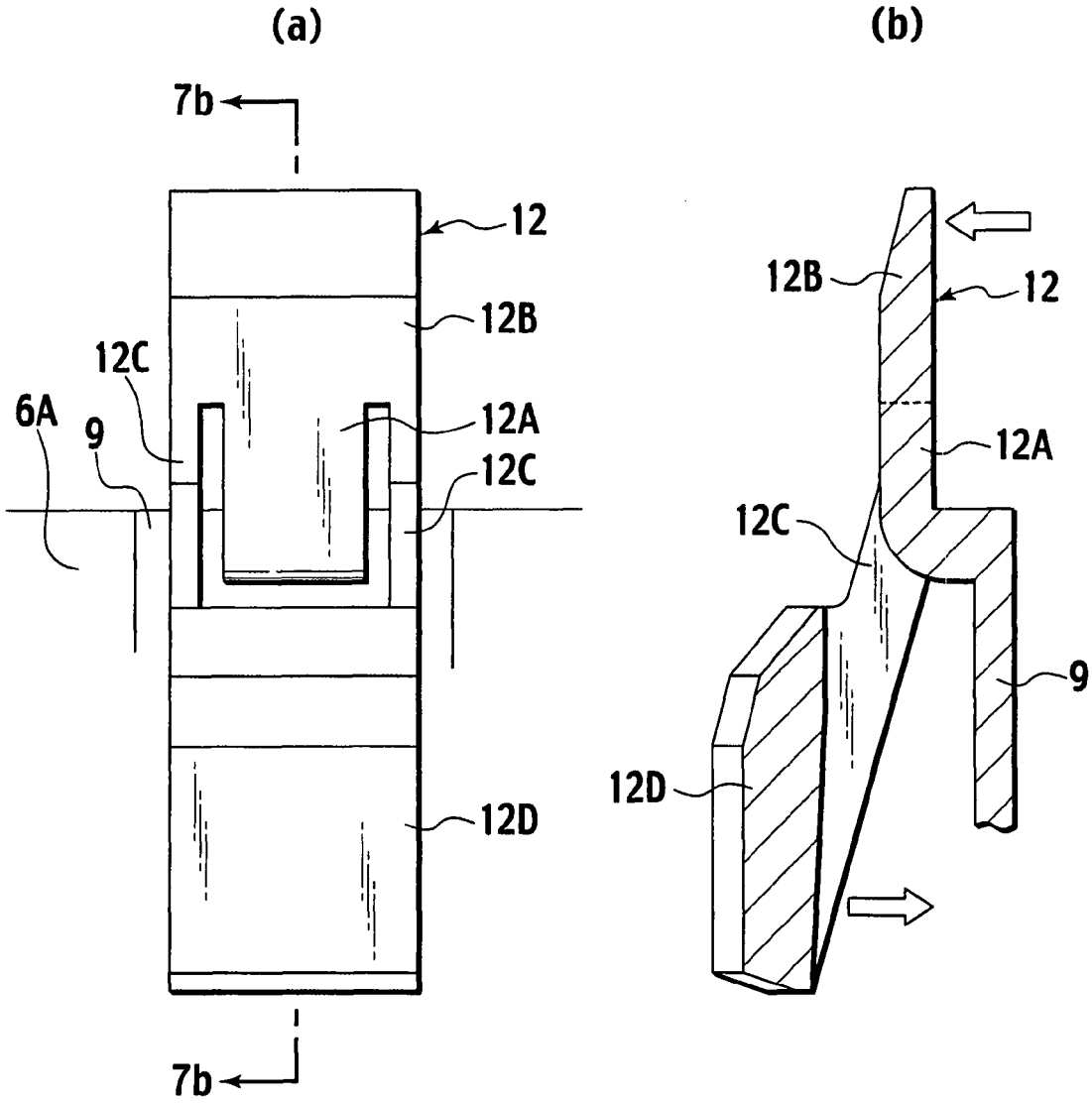
FIG. 7(*a*) is a front view of an anti-rotation lock of the lever-fitting type connector according to the embodiment of the present invention, and FIG. 7(*b*) is a cross-sectional view taken along 7*b*-7*b* of FIG. 7(*a*)

As shown in FIGS. 5 and 7, the anti-rotation lock 12 is provided on an end of an inlet of the cylinder 9 of the female housing 2. This anti-rotation lock 12 has an intermediate portion formed integrally with the cylinder 9, and a release-operation plate member 12B is formed above and continuously with a support member 12A rising from the end of the inlet of the cylinder 9 and exhibiting repellence. Trailing arms 12C extend from lower portions of respective both sides of this release-operation plate member 12B toward inward of the lever insertion hole 6, and ends of the paired trailing arms 12C are formed continuously with a generally-rectangular rotation locking member 12D.

As shown in FIG. 8, the rotation locking member 12D of the anti-rotation lock 12 is located to be shifted toward a lever inlet side of the lever insertion hole 6 with respect to the rib 10 and the lever holding protrusion 11A of the lever holding lock 11. Furthermore, in the present embodiment, the anti-rotation lock 12 is arranged at a position at 180 degrees with respect to the lever holding lock 11, that is, at a position opposed to the lever holding lock 11 around the rotation axis of the lever insertion hole 6.

Moreover, as shown in FIG. 3, a partition plate 13 that divides the through wiring path 8 from the fitted portion of the female housing 2 is formed on the side of the female housing 2 on which side the female housing 2 is fitted into the male housing 3.

[Configuration of Male Housing]

A configuration of the male housing 3 will be described next with reference to FIGS. 3 to 5. A hood member 14 protruding toward the female housing 2 is formed on a fitted surface of a main body of the male housing 3, and the female housing 2 is fitted into this hood member 14. The hood member 14 is shaped to surround a portion of the male housing 3 in which portion the female housing 2 is fitted into the male housing 3, and structured such that the partition plate 13 of the female housing 2 is arranged outside of the hood member 14 when the female and male housings 2 and 3 are fitted into each other. Moreover, a plurality of cavities 15 is formed in the main body of the male housing 3 within the hood member 14 along the fitting directions A. A male-terminal metal fitting (not shown) is stored and fixed in each of these cavities 15, and the male-terminal metal fittings protrude into the hood member 14.

A pair of lever engagement plates 16, which are opposed to each other and opposed surfaces of which form a part of a circumferential surface of an imaginary cylinder, are provided at a generally central portion of the male housing 3 to protrude into the hood 14. It is to be noted that the opposed surfaces of these paired lever engagement plates 16 are set to have such dimensions as to slidably contact with an outer circumferential surface of the lever 5. Furthermore, engagement protrusions 16A to be captured by and stored in screw grooves 55A and 55B formed on the outer circumferential surface of the lever 5, to be described later, protrude at positions at which they are opposed each other on the opposed surfaces of the paired lever engagement plates 16, respectively.

[Configuration of Moving Plate]

A configuration of the moving plate 4 will be briefly described with reference to FIG. 3. The moving plate 4 is shaped to be stored in the hood member 14 of the male housing 3, and a plurality of terminal insertion holes 17 into which the respective male-terminal metal fittings (not shown) protruding in the hood member 14 are inserted is formed in the moving plate 4. A generally rectangular notch 18 into which the paired lever engagement plates 16 within the hood member 14 of the male housing 3 are inserted is formed in the moving plate 4. Stopper pieces 19 to be engaged with stopper protrusions (not shown) formed at the female housing 2 are formed in four corners of this notch 18, respectively, to protrude toward the female housing 2. Furthermore, stopper pieces 20 are formed to protrude in four portions of a peripheral edge of the moving plate 4, respectively.

[Configuration of Lever]

A configuration of the lever 5 will be described next with reference to FIGS. 3 to 5, 8, and 10. In the present embodiment, the lever 5 is configured such that a lever main body 51 to be inserted into the female and male housings 2 and 3, and operating units 52 and 53 provided on a rear end of the lever 5 on opposite side to a direction in which this lever main body 51 is inserted into the female housing 2 for performing a rotation operation by a hand are formed. The operating unit 52 is a relatively long rod-like grip member provided at right angle with respect to the lever main body 51, and the operating unit 53 is provided at a predetermined angle (which is about 70 degrees in this embodiment) with respect to the operating unit 52 and at right angle with respect to the lever main body 51.

The lever main body 51 is set to have a length so as to at least penetrate the lever insertion hole 6 of the female housing 2 and arrive between the paired lever engagement plates 16 of the male housing 3 in a state where the female housing 2 is not fitted into the male housing 3 and where the both housings 2 and 3 abut on each other.

A tip end of the lever main body 51 is formed to be tapered toward the tip end. Because of such a structure tapered toward the tip end, the lever main body 51 can be easily guided to the lever insertion hole 6 of the female housing 2 and to between the paired lever engagement plate 16 of the male housing 3.

Moreover, one key groove 54 serving as a linear guide groove having a predetermined length from the tip end of the lever main body 51 along axial direction is formed on a circumferential surface of the lever main body 51. The screw grooves 55A and 55B each almost making a turn are formed in a range shorter than the length of the key groove 54 from the tip end of the lever main body 51 in parallel to start spirally at opposed circumferential surfaces of the tip end portion, respectively.

This key groove 54 is set to have such a length that both starting points (tip ends) of the screw grooves 55A and 55B on the tip end portion can pick up (store) the engagement protrusions 16A protruding on the opposed surfaces of the respective paired lever engagement plates 16 of the male housing 3 when a rear end of the key groove 54 is inserted into positions of the rib 10 and the lever holding protrusion 11A of the lever holding lock 11.

Figure 10:
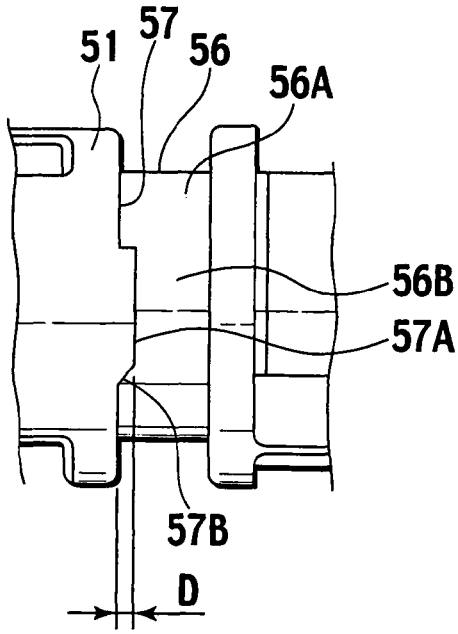
FIG. 10 is a side view of principal parts of the lever according to the embodiment of the present invention.

Moreover, the rear end of the key groove 54 is formed to be continuous with a lever retaining groove 56 formed circumferentially around the lever main body 51. As shown in FIG. 10, a stepped portion 57A is formed in a predetermined area of a wall member (sidewall surface) 57 of this lever retaining groove 56 located on the tip end side of the lever main body 51. One end of the stepped portion 57A is formed to be continuous with the wall member 57 via a tapered surface 57B. The stepped portion 57A has a height difference D from the wall member 57.

Figure 11:
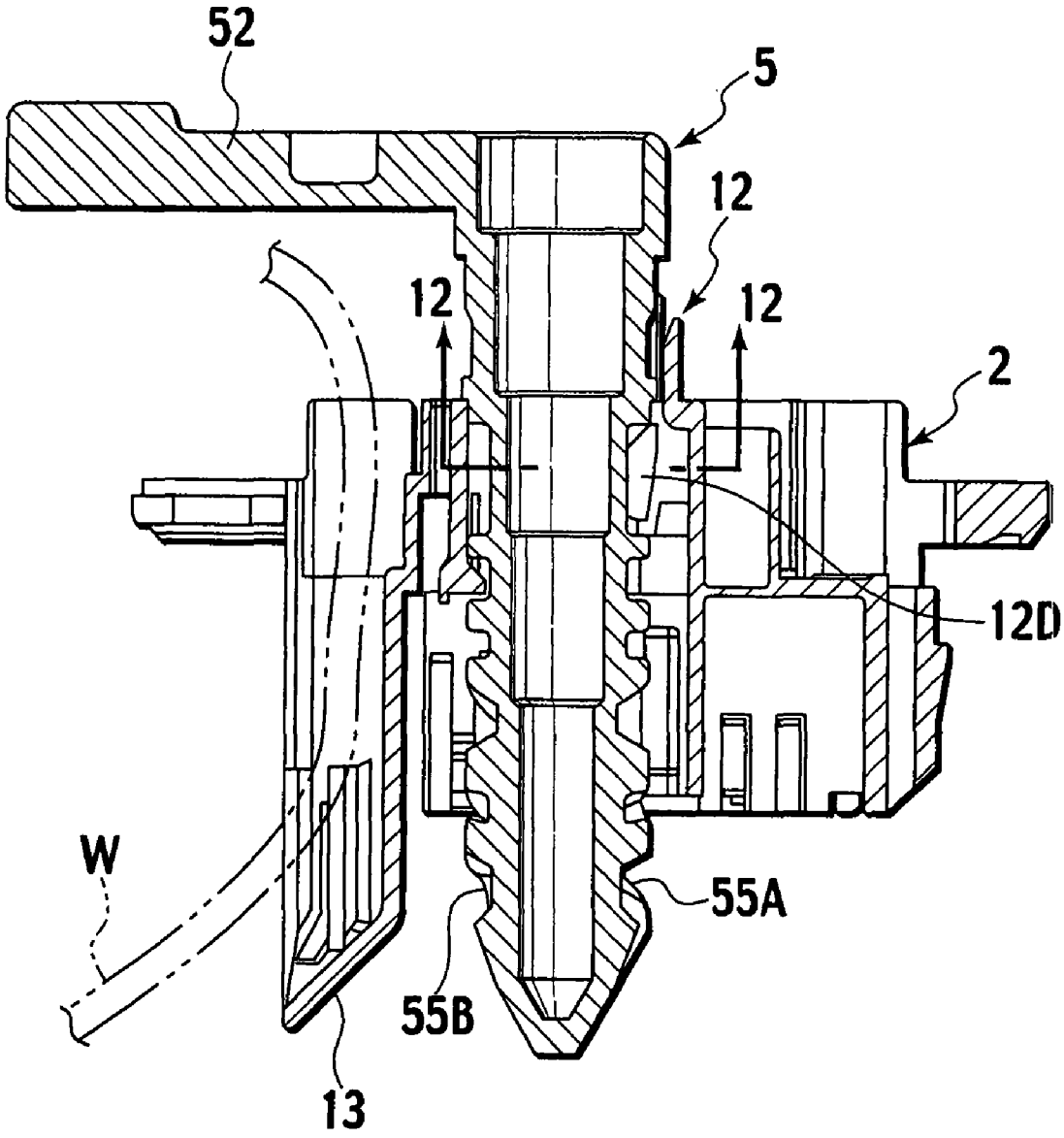
FIG. 11 is a cross-sectional view showing a state where the female housing is fully engaged with the lever in the lever-fitting type connector according to the embodiment of the present invention.
Figure 12:
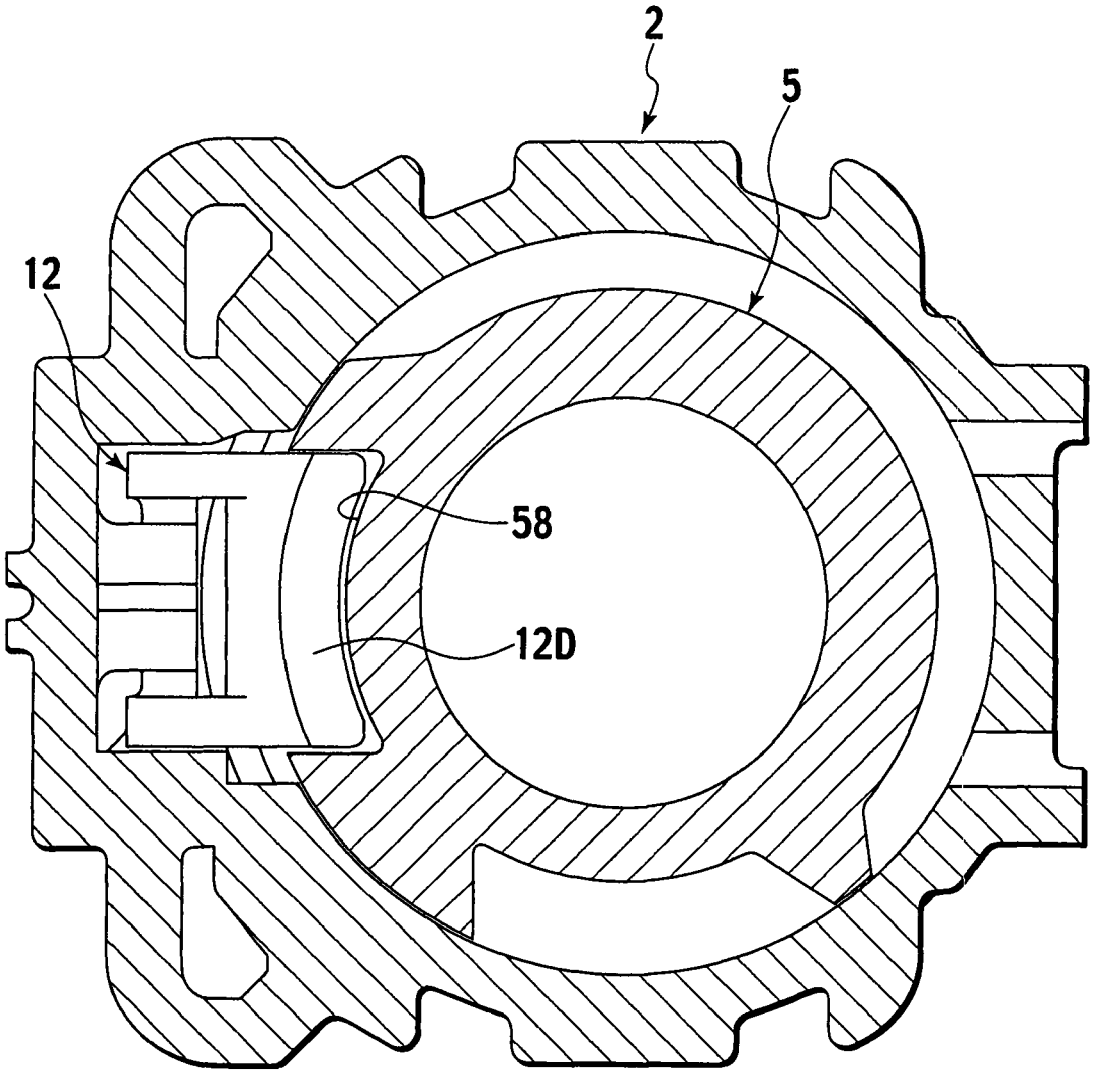
FIG. 12 is a cross-sectional view taken along 12-12 of FIG. 11.

Furthermore, as shown in FIGS. 3 and 5, a, rotation-locking concave portion 58 in which the rotation locking member 12D of the anti-rotation lock 12 is to be stored is formed in rear of the lever retaining groove 56 of the lever main body 51 (on a rear end side of the lever main body 51). As shown in FIG. 11, this rotation-locking concave portion 58 is set to be located at a position so that the rotation locking member 12D of the anti-rotation lock 12 is stored in the rotation-locking concave portion 58 when the lever 5 is operated to complete connection between the female housing 2 and the male housing 3. Further, as shown in FIG. 12, a length of the rotation-locking concave portion 58 in a circumferential direction of the lever main body 51 is set to be slightly larger than a width of the rotation locking member 12D. FIG. 12 is a cross-sectional view taken along 12-12 of FIG. 11.

[Function and Operation of Lever-Fitting Type Connector]

A function and an operation of the lever-fitting type connector according to the present embodiment will be described.

(Connection Operation)

First, as shown in FIG. 3, the moving plate 4 is set into the male housing 3. At this time, the male-terminal metal fittings (not shown) protruding in the hood member 14 of the male housing, 3 are inserted into the corresponding terminal insertion holes 17 formed in the moving plate 4, respectively. As shown in FIG. 11, a wire harness W necessary for through wiring is inserted into the through wiring path 8 of the female housing 2.

Next, connected surfaces of the female housing 2 and the male housing 3 are abutted against each other and temporarily stopped at each other. The tip end side of the lever 5 is then inserted into the lever insertion hole 6 from the female housing 2 side. At this time, the lever 5 is rotated to be placed so that the key groove 54 formed in the lever main body 51 of the lever 5 can store therein the rib 10 protruding into the lever insertion hole 6. By doing so, since the key groove 54 is the linear groove along the axial direction of the lever main body 51, the lever main body 51 can be inserted into the lever insertion hole 6 while the rib is stored in the key groove 54.

Thereafter, as the insertion of the lever main body 51 into the lever insertion hole 6 proceeds, the rib 10 abuts on a sidewall of the lever retaining groove 56 and further insertion is thereby prevented. In this manner, simultaneously with movement of the rib 10 to the retaining groove 56, the lever holding protrusion 11A of the lever holding lock 11 overpasses the wall member 57 side and falls down into the retaining groove 56 due to the repellence as shown in FIG. 6. Forward and backward operations of the lever main body 51 are prevented by the lever holding protrusion 11A, whereby the lever 5 is temporarily stopped at the female housing 2. In this state, the lever holding lock 11 is stored in the retaining groove 56 after being bent outward; therefore, a dimension of the lever holding lock 11 corresponding to an overstroke thereof is present as a clearance between the lever holding lock 11 and the wall member 57.

At this moment, tip ends of the screw grooves 55A and 55B of the lever main body 51 are in states where they can cooperatively pick up the engagement protrusions 16A protruding on the opposed surfaces of the paired lever engagement plates 16. In addition, in this temporarily stopped state, the rotation locking member 12D of the anti-rotation lock 12 is stored in a concave portion 59 circumferentially adjacent to the rotation-locking concave portion 58 formed in the lever main body 51.

Next, in the present embodiment, the operating units 52 and 53 of the lever 5 thus temporarily stopped are rotated counterclockwise, whereby the tip ends of the screw grooves 55A and 55B pick up (store) the engagement protrusions 16A of the lever engagement plates 16, and the female housing 2 and the male housing 3 are drawn toward each other and fitted into each other.

When rotation of the lever 5 temporarily stopped at the female housing 2 reaches a predetermined rotation angle (about 270 degrees in this embodiment), the engagement protrusions 16A are located on rear ends of the screw grooves 55A and 55B. At this time, the rotation locking member 12D of the anti-rotation lock 12 overpasses the wall member that separates the concave portion 59 from the rotation-locking concave portion 58 and is stored in the rotation-locking concave portion 58. At this moment, the rotation locking member 12D is engaged with the rotation-locking concave portion 58 and the rotation operation of the lever main body 51 turns into a prevented state (a fully stopped state). The lever holding protrusion 11A of the lever holding lock 11 makes relative movement along the wall member 57 and abuts on the stepped portion 57A via the tapered surface 57B to eliminate the clearance, so that it is possible to prevent the lever 5 from becoming shaky in the axial direction. At the same time, the rib 10 makes relative movement to a position of the retaining groove 56 deviated from the key groove 56, so that the rib 10 as well as the lever holding lock 11 prevents the axial movement of the lever 5. Moreover, by preventing the rotation of the lever 5, the fitting of the female housing 2 into the male housing 3 is held without change in the positions of the engagement protrusions 16A relative to the screw grooves 55A and 55B.

(Release Operation)

An operation for releasing connection of the lever-fitting type connector 1 in the state where the female housing 2 is connected to the male housing 3 as stated above will be described next.

As shown in FIG. 7B, first, the release-operation plate member 12B is pressed by a finger toward inside of the lever insertion hole 6 (indicated by a thick arrow in FIG. 7B). By doing so, the rotation locking member 12D stored in the rotation-locking concave portion 58 is moved outward (indicated by a thick arrow in FIG. 7B) with the support member 12A used as a fulcrum, thus making the lever main body 51 rotatable.

In this state, the operating units 52 and 53 are grasped and rotated in opposite direction to the direction for the connection operation (clockwise in this embodiment) so that the key groove 54 formed in the lever main body 51 is collinear with the rib 10. As a result, the engagement protrusions 16A in the screw grooves 55A and 55B are guided and driven toward the tip ends of the screw grooves 55A and 55B, whereby the fitting of the female housing 2 into the male housing 3 is released. In this state, the lever holding protrusion 11A of the lever holding lock 11 is stored in the retaining groove 56. Due to this, the lever holding protrusion 11A abuts against the wall member 57 of the retaining groove 56, so that the lever main body 51 cannot be pulled out from the lever insertion hole 6.

In this state, the lever release protrusion 11B is bent outward toward a position indicated by a chain line shown in FIG. 6 using a release tool or the like, thereby making it possible to move the lever main body 51 in the axial direction. In this state, the lever main body 51 can be pulled out from the lever insertion hole 6.

With the lever-fitting type connector 1 according to the embodiment described above, the lever 5 can be inserted into the lever insertion hole 6 only when the rib 10 provided on the inner wall 6A of the lever insertion hole 6 formed in the female housing 2 meshes with the key groove 54 formed in the lever 5. It is, therefore, possible to prevent the lever 5 from being inserted into the female housing 2 when the lever 5 is located at positions other than the predetermined rotation position and to prevent so-called connection error.

Moreover, according to the present embodiment, the lever holding lock 11 having flexibility and the rib 10 that are provided on the inner wall 6A of the lever insertion hole 6 simultaneously abut on the wall member 57 of the retaining groove 56 serving as a retaining unit provided in the lever 5, and can prevent the lever 5 from coming off and hold the lever 5. It is, therefore, possible to increase holding force for temporarily stopping (holding) the lever 5 at the female housing 2. Further, to release the lever 5, the axial movement of which is restricted by the lever holding lock 11 and the rib 10, from the female housing 2, it suffices to perform an operation for releasing only a state where the lever holding lock 11 is engaged with the lever 5 while the anti-rotation lock 12 is temporarily unlocked. It is, therefore, possible to improve lever release operability.

Furthermore, according to the present embodiment, the rib 10 provided on the inner wall 6A of the lever insertion hole 6 is stored in the key groove 54 of the lever 5, whereby the lever 5 can be inserted into the lever insertion hole 6. It is, therefore, possible to set the dimension for close fitting so as not to generate backlash between the lever insertion hole 6 and the lever 5. This can prevent the lever 5 from becoming shaky irrespectively of strength and magnitude of the lever holding lock 11 having flexibility. Accordingly, if the male housing 3 is to be connected to the female housing 2 by rotating the lever 5 while the lever 5 is being held at the female housing 2, then it is possible to suppress shaking the lever 5 and ensure connecting the male housing 3 to the female housing 2 side.

Moreover, according to the present embodiment, the rib 10 and the lever holding protrusion 11A of the lever holding lock 11 are arranged at the positions deviated from each other in the longitudinal direction of the lever main body 51 by as much as the overstroke of the lever holding lock 11. Due to this, as shown in FIG. 10, a wall surface of a wide portion 56 (the wall member 57) on which the rib 10 abuts and a wall surface of a narrow portion 56B (the stepped member 57A) on which the lever holding protrusion 11A of the lever holding lock 11 abuts are formed on the lever 5, thereby making it possible to prevent the lever 5 from becoming shaky. Specifically, the wall surface of the wide portion 56A (the wall member 57) and that of the narrow portion 56B (the stepped member 57A) are made continuous on the tapered surface 57B, whereby the female housing 2 is fitted into the male housing 3. Accordingly, when the lever 5 is rotated, the lever holding protrusion 11A of the lever holding lock 11 can slide on the tapered surface 57B and the wall surface of the narrow portion 56B (stepped member 57A) can smoothly move toward the lever holding protrusion 11A, thereby making it possible to improve operability.

Furthermore, according to the present embodiment, the operating units 52 and 53 are provide integrally with the base of the lever 5, thereby making it possible to facilitate rotating the lever 5.

Other Embodiments

The descriptions and drawings that constitute a portion of this disclosure should not be perceived as limiting the present invention. Various alternative embodiments, examples, and operational techniques will become apparent to persons skilled in the art from this disclosure.

Figure 13:
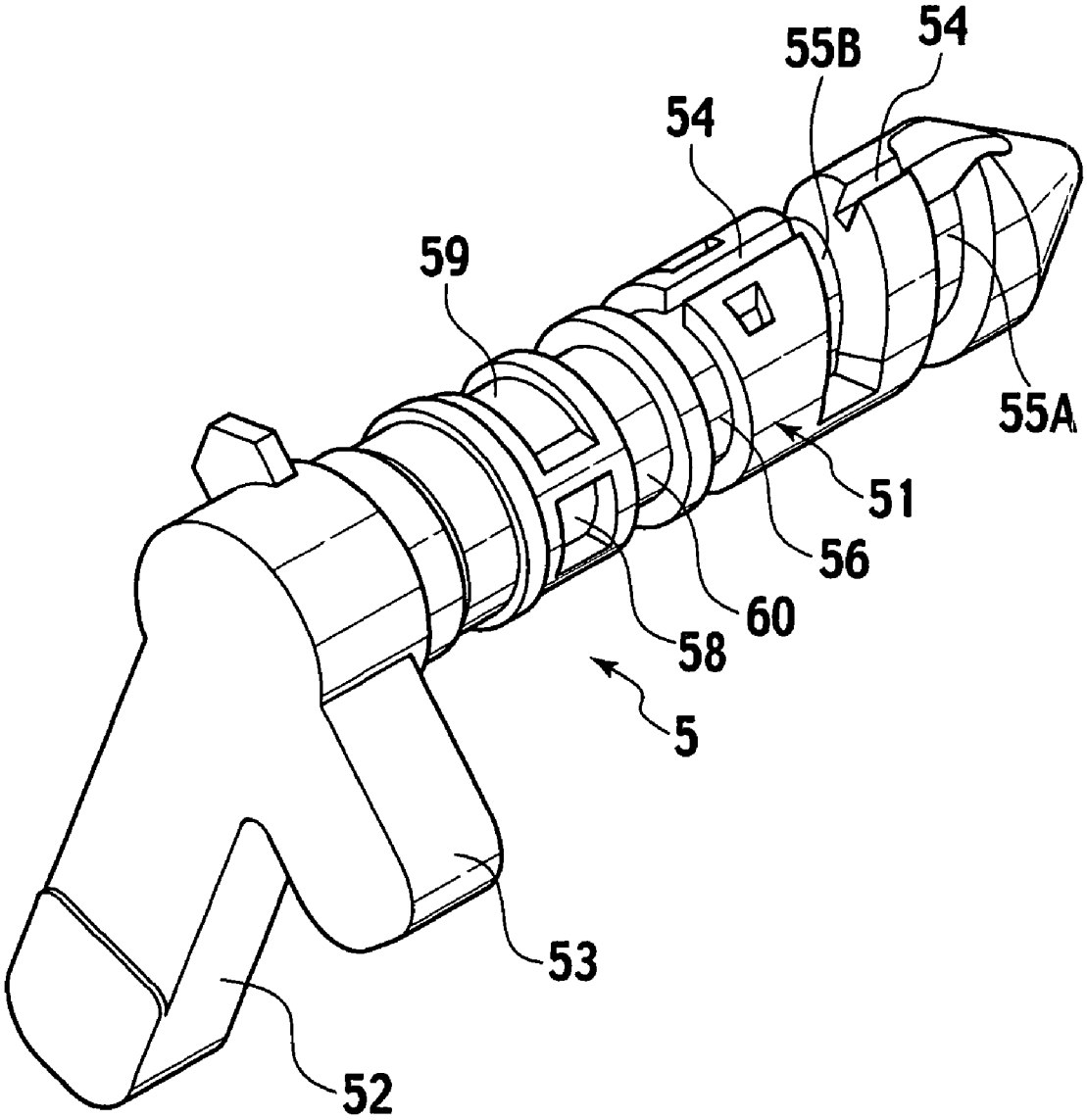
FIG. 13 is a perspective view showing a lever according to another embodiment.

For example, according to the embodiment described above, the lever holding lock 11 and the rib 10 are set to be thrust into the same retaining groove 56 simultaneously. Needless to say, alternatively, a first retaining groove 56 that restricts the axial movement of the lever 5 by causing the rib 10 to abut on the inner wall 6A when the lever 5 is held in the lever insertion hole 6 of the female housing 2 and a second retaining groove 60 parallel to the first retaining groove 56 can be formed in the lever 5 as shown in FIG. 13. In this case, even if the lever 5 and the lever holding lock 11 are located at different positions in the axial direction of the lever insertion hole 6, the lever 5 and the lever holding lock 11 can prevent the lever 5 from coming off and hold the lever 5 simultaneously.

Moreover, in the above embodiment, the lever-fitting type connector 1 is configured to temporarily stop the lever 5 at the female housing 2. Needless to say an alternatively, the lever 5 can be temporarily stopped at the male housing 3.

Further, in the embodiment described above, the instance of simply connecting the female housing 2 to the male housing 3 has been described. Alternatively, the present invention can be applied to a case where a car interior-side connector housing and an engine room-side connector housing are connected to each other via, for example, an instrument panel of a car between them. In this case, a penetrating hole is formed in the instrument panel, the other housing is temporarily stopped from an opposite side to the instrument panel while holding one housing at the instrument panel, and the lever 5 is rotated from, for example, the car interior side. It is thereby possible to connect the connector housings to each other and facilitate connector attachment operations.

INDUSTRIAL APPLICABILITY

According to the present invention, it is possible to provide a lever-fitting type connector that can be downsized and that can improve lever release operability.

The invention claimed is:

1. A lever-fitting type connector comprising:

a first connector housing;

a second connector housing to be fitted into the first connector housing; and a lever rotatably held by the first connector housing, drawing the second connector housing by being rotated to fit the first connector housing and the second connector housing into each other, and including a guide groove axially formed on an outer circumferential surface of the lever, wherein the first connector housing includes an insertion hole into which the lever is to be inserted, and a rib making the lever insertable into the first connector housing via the guide groove of the lever only when the lever is located at a predetermined rotation position and a lever-holding lock having flexibility are provided on an inner wall of the insertion hole, and the rib as well as the lever-holding lock abuts on a retaining unit provided on the lever, thereby preventing the lever from coming off and holding the lever.

2. The lever-fitting type connector according to claim 1, wherein the retaining unit includes a wall member of a first retaining groove provided continuously with the guide groove in a circumferential direction of the lever, the rib abutting on the first retaining wall; and a wall member of a second retaining groove provided parallel to the first retaining groove in the circumferential direction of the lever, the lever-holding lock abutting on the second retaining groove.

3. The lever-fitting type connector according to claim 1, wherein the rib is arranged to be deviated from an abutment portion in which the lever-holding lock abuts on the retaining unit in a longitudinal direction of the lever by as much as an overstroke of the lever-holding lock, the retaining unit is a wall surface of the retaining groove provided continuously with the guide groove in the circumferential direction of the lever located, the wall surface located on a tip end side of the lever, and the retaining groove includes a wide portion abutted on by the rib and having a fixed width, and a narrow portion abutted on by the lever-holding lock only while the lever is fully stopped so that the retaining groove can prevent the lever from coming off and hold the lever simultaneously with the rib.

4. The lever-fitting type connector according to claim 3, wherein the wide portion and the narrow portion are continuous with each other via a tapered surface.

5. The lever-fitting type connector according to claim 1, wherein an operating unit is provided integrally with a base of the lever.

* * * * *